US007866325B2

(12) United States Patent
Woods

(10) Patent No.: US 7,866,325 B2
(45) Date of Patent: Jan. 11, 2011

(54) SMOKING ARTICLES

(75) Inventor: Debra Demeter Woods, Orrell Park (GB)

(73) Assignee: British American Tobacco (Investments) Limited, London (GB)

( * ) Notice: Subject to any disclaimer, the term of this patent is extended or adjusted under 35 U.S.C. 154(b) by 1176 days.

(21) Appl. No.: 10/538,516

(22) PCT Filed: Dec. 5, 2003

(86) PCT No.: PCT/GB03/05310

§ 371 (c)(1), (2), (4) Date: Aug. 1, 2006

(87) PCT Pub. No.: WO2004/052128

PCT Pub. Date: Jun. 24, 2004

(65) Prior Publication Data

US 2007/0051383 A1 Mar. 8, 2007

(30) Foreign Application Priority Data

Dec. 11, 2002 (GB) ..... 0228819

(51) Int. Cl.

| | |
|---|---|
| ***D21H 11/00*** | (2006.01) |
| ***D21H 13/00*** | (2006.01) |
| ***D21H 15/00*** | (2006.01) |
| ***D21H 17/00*** | (2006.01) |
| ***D21H 19/00*** | (2006.01) |
| ***D21H 21/00*** | (2006.01) |
| ***D21H 23/00*** | (2006.01) |
| ***D21H 25/00*** | (2006.01) |
| ***D21H 27/00*** | (2006.01) |

(52) U.S. Cl. ..... 131/365; 131/276; 131/278; 131/277; 131/279

(58) Field of Classification Search ..... None
See application file for complete search history.

(56) References Cited

U.S. PATENT DOCUMENTS

| | | | | |
|---|---|---|---|---|
| 3,006,347 | A | 10/1961 | Keaton | |
| 3,162,199 | A | 12/1964 | Moll, Jr. | |
| 4,082,098 | A * | 4/1978 | Owens, Jr. | 131/274 |
| 4,431,680 | A * | 2/1984 | Yoshida | 426/538 |

(Continued)

FOREIGN PATENT DOCUMENTS

| | | |
|---|---|---|
| EP | 0294972 B1 | 9/1992 |

(Continued)

OTHER PUBLICATIONS

Simon Benita, Microencapsulation: methods and indstrial applications, 73, 366-367.*

*Primary Examiner*—Philip C Tucker
*Assistant Examiner*—Phu H Nguyen
(74) *Attorney, Agent, or Firm*—Charles I. Sherman; Middleton Reutlinger

(57) ABSTRACT

The present invention relates to a smoking article comprising two layers of wrapper material, the outer wrapper having an air permeability of at least 200 C.U. and having a greater permeability than the inner wrapper. Encapsulated flavour is held between the inner and outer wrappers. The encapsulation technique is dependent upon the flavour to be encapsulated and the sidestream to mainstream flavour delivery ratio required. Sidestream smoke may be altered without altering the mainstream smoke, thereby altering room odors.

29 Claims, 4 Drawing Sheets

U.S. PATENT DOCUMENTS 5,494,055 A * 2/1996 Noe et al. ..... 131/365
6,489,103 B1 * 12/2002 Griffiths et al. ..... 435/6

FOREIGN PATENT DOCUMENTS

EP 0503795 A3 9/1992
EP 0868857 B1 10/2002
GB 2007078 A 5/1979
GB 2020158 A 11/1979
GB 2078488 A 1/1982

* cited by examiner

SMOKING ARTICLES

CROSS REFERENCE TO PRIOR APPLICATION

This application is a national stage filing (35 U.S.C. 371) of PCT/GB2003/005310, filed on Dec. 5, 2003, which claims priority to and benefit from Great Britain Patent Application No. 0228819.9, filed on Dec. 11, 2002, currently pending.

This invention relates to the provision of flavour material to smoking articles, particularly but not exclusively cigarettes.

The application of flavour materials to modify smoke taste or other characteristics has been a desideratum for many years. A major problem with such a requirement to add flavourant material to smoking articles, though, is the generally volatile or semi-volatile nature of the flavourant material to be added. Over the years the application of flavour has been concentrated on spraying flavour material in solution (aqueous or not) directly onto cut tobacco during or towards the end of primary processing or by spraying or coating flavour material onto the cigarette paper, for example. In more recent years, attempts have been made to capture the volatile or semi-volatile flavourants in another medium to prevent evaporation of the flavour materials during processing. Flavourants have been encapsulated in a film forming vehicle (U.S. Pat. No. 3,006,347) and applied to the wrapper, encapsulated in a tubular ribbon of non-toxic material, such as ethyl cellulose (U.S. Pat. No. 3,162,199), screen printed onto a wrapper as a series of discrete dots of ink containing an additive to be released as the hot burning tip approaches (GB Patent No. 2 007 078), coated onto a thread or tape (GB 2 020 158) and deposited along the length of the tobacco rod or passing as granules of encapsulated flavourant into the garniture of a cigarette making machine (GB Patent No. 2 078 488).

More recently, instead of targeting alteration of the mainstream smoke quality or characteristics there has been interest in, instead, diverting flavourant into the sidestream smoke of a smoking article. In this way the sometimes offensive odour of sidestream smoke, and particularly stale sidestream smoke, can be reduced or masked. European Patent Publication No. 0 503 795 describes a molecular inclusion complex of β-cyclodextrin and vanillin which can be applied in a reconstituted tobacco sheet or to the paper wrapper. European Patent No. 0 294 972 describes a flavourant material, particularly glucosides, which pyrolyses on combustion and smouldering to produce an aromatic agent which masks the odour of sidestream smoke. The masking agent is preferentially incorporated into or impregnated onto cigarette paper, rather than introduced into the tobacco.

More recently, U.S. Pat. No. 5,494,055 described an aroma mixture for reducing undesired sidestream smoke effects. The aroma mixture can be applied in encapsulated or unencapsulated form into or onto a single layered cigarette wrapper or a double layered wrapper. The double wrapped embodiment comprised an outer, visible layer of cigarette paper having an air permeability of 3-150 Coresta Units (C.U.) and an inner non-visible layer of highly porous, fine-mesh cellulose fibre grid (also known as tobacco cartridge covering material, K paper) having a permeability of 4,000-80,000 C.U. and preferably carries the aroma mixture. The flavour in this instance is an aroma mixture containing at least vanillin, an aldehyde, and a heterocyclic compound in an ethanol solution. No details are given of the encapsulation techniques used for this specific aroma mixture.

This invention has as an object the provision of a smoking article having an increased delivery of flavour material into the sidestream smoke than previously obtained.

It is another object of the invention to identify the preferred location and/or encapsulation methods to achieve an enhanced delivery of flavour material into the sidestream smoke of a smoking article.

It is a further object of the invention to provide a sidestream to mainstream smoke flavour delivery ratio of at least 4.5:1, or more.

The present invention provides a smoking article having sidestream smoke flavour, the smoking article comprising a rod of smoking material enwrapped in wrapper means, the wrapper means comprising two layers of wrapper material, and encapsulated flavour material being held between an inner and an outer layer of the wrapper means, the outer layer being a wrapper material having a total air permeability of at least 200 Coresta Units (C.U.), and being of a total air permeability greater than that of the inner wrapper material.

Preferably the outer layer of wrapper material has a total air permeability greater than 200 C.U., and preferably at least 300 C.U., preferably at least 500 C.U., more preferably at least 600 C.U., and even more preferably at least 1,000 C.U. Advantageously, the total air permeability can be additionally incremented in units of 1000 C.U, up to at least 6,000 C.U., such that the total air permeability of the outer wrapper material may be at least 2,000 C.U., 3,000 C.U., 4,000 C.U., 5,000 C.U. or 6,000 C.U. The permeability of the wrapper may suitably even be as high as at least 10,000 C.U.

The total air permeability of the inner wrapper material is preferably below 200 C.U., and preferably is in the range of 25-150 C.U., more preferably 30-100 C.U. and is even more preferably about 50 C.U.

Preferably the flavour material is encapsulated by the encapsulation method most appropriate to obtain the sidestream to mainstream delivery ratio (SS:MS) required for the particular flavour material selected, the sidestream to mainstream delivery ratio being the ratio required to achieve a noticeable flavour in the sidestream smoke without affecting the mainstream smoke taste.

Preferably the encapsulated form of flavour is present between the inner and outer layers of the wrapper as capsules. Alternatively, the encapsulated form is a thread.

The encapsulated flavour material may be produced using the following encapsulation techniques: interfacial complexation, molecular entrapment, complex coacervation, preferential precipitation, interfacial polymerisation, melt/wax coating, spray drying, in-situ polymerisation, agglomeration. Most preferably the encapsulated flavour material is produced using interfacial complexation.

Advantageously when the flavour material is gamma undecalactone the SS:MS delivery ratio is preferably at least 6:1 and is more preferably at least 10:1, is even more preferably at least 15:1, and is most preferably at least 20:1.

Advantageously when the flavour material is peppermint oil the SS:MS delivery ratio is at least 2:1 and is preferably at least 4:1. More preferably the SS:MS delivery ratio is at least 200:1 and is most preferably about 400:1.

Advantageously when the flavour material is spearmint oil the SS:MS delivery ratio is preferably at least 4.5:1, more preferably at least 6:1 and even more preferably at least 9:1. Preferably the SS:MS delivery ratio is at least 100:1 and is even more preferably about 200:1.

When the flavour materials is or comprises gamma undecalactone the flavour material is advantageously encapsulated using the following methods, in order of preference: interfacial complexation, preferential precipitation, agglomeration, spray drying.

When the flavour material is or comprises peppermint oil the flavour material is advantageously encapsulated using the following methods, in order of preference: interfacial complexation, agglomeration, spray drying.

When the flavour material is; or comprises spearmint oil the flavour material is advantageously encapsulated using the following methods, in order of preference: interfacial complexation, molecular entrapment (hydrophobic), Molecular entrapment (non-hydrophobic), complex coacervation.

Preferably the cation for interfacial complexation is selected according to the following cation list, in order of preference: Ca(acetate), $Al^{3+}$, $V^{4+}$, $Zn^{2+}$, $Cu^{2+}$, Ca(chloride).

The order of cation list may vary in accordance with the flavour selected.

Advantageously the smoking article is ventilated. Ventilation decreases the mainstream delivery and suitably decreases the SS:MS delivery ratio required for each flavour.

Advantageously for gamma undecalactone the sidestream to mainstream flavour delivery ratio for a thread produced by interfacial complexation is greater than 15:1.

Advantageously for gamma undecalactone the sidestream to mainstream flavour delivery ratio for capsules produced by interfacial complexation is greater than 15:1, and is more advantageously greater than 20:1.

Advantageously for gamma undecalactone the sidestream to mainstream flavour delivery ratio for such capsules is greater than 10:1, and is preferably at or about 14:1.

Advantageously for peppermint oil the sidestream to mainstream delivery ratio, for capsules produced by interfacial complexation is greater than 4:1.

Advantageously for spearmint oil the sidestream to mainstream delivery ratio for capsules produced according to interfacial complexation is greater than 9:1.

The present invention further provides a method of improving the residual odour of a room, the method comprising producing a smoking article having sidestream smoke flavour in accordance with the invention.

Flavours that may be used in the present invention include volatile flavours such as menthol, vanillin, peppermint, spearmint, isopinocampheol, isomenthone, mint cooler (obtained from the flavour house IFF), neomenthol, dill seed oil or other similar flavour materials, and mixtures thereof. The invention is suitable for any volatile or semi-volatile flavourant.

In order that the invention may be easily understood and readily carried into effect, reference will now be made to the following Examples and the diagrammatic drawings hereof, wherein.

Figure 1:
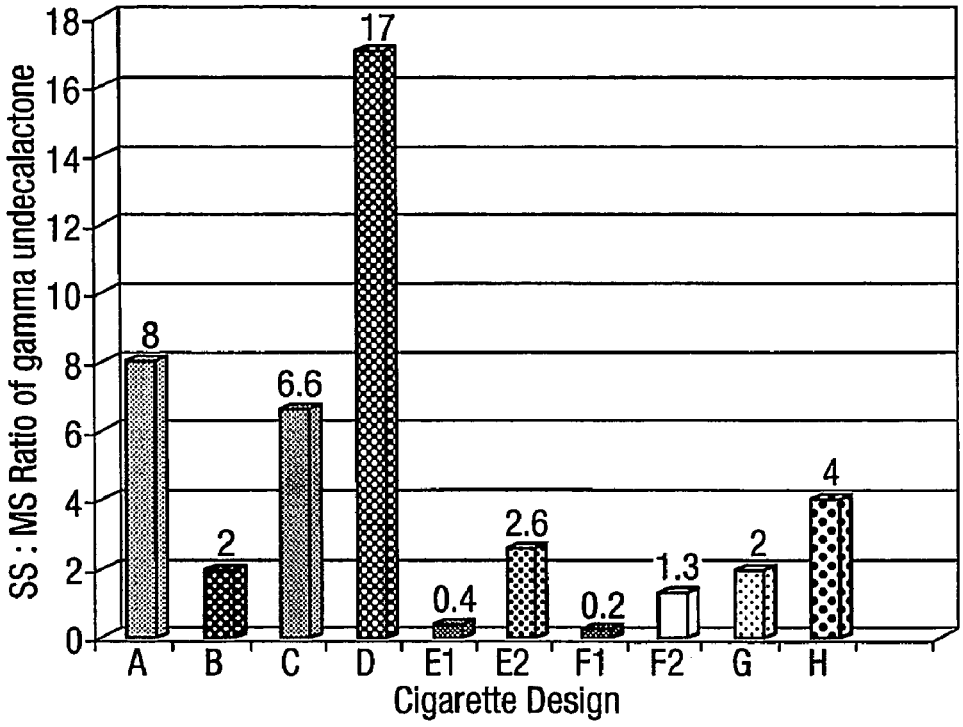
FIG. 1 shows the sidestream to mainstream flavour delivery ratio for gamma undecalactone in different cigarette designs. The numbers above the columns are puff numbers.

Previous work using a model system comprising chemically stabilised gamma undecalactone (a non-polar single compound, the lactone ring being stabilised by converting to the potassium salt) has been found to provide a sidestream to mainstream flavour delivery ratio of 3:1 when the chemically stabilised material is applied to a single cigarette wrapper. This provided a control cigarette sidestream to mainstream flavour delivery ratio for the following examples.

EXAMPLE 1

A number of well-known encapsulation techniques were employed to encapsulate three different flavours, namely gamma undecalactone, peppermint oil (a complex mixture of over 20 aroma chemicals, the major constituent being menthol) and spearmint oil (a complex mixture of aroma chemicals, the major constituent being L-carvone). Peppermint oil was chosen to complement menthol cigarettes by producing a "fresh sidestream" aroma Spearmint oil was chosen to complement menthol cigarettes by producing a "fresh/minty" sidestream aroma.

There now follows a brief description of the various encapsulation techniques used to encapsulate the three flavours. Encapsulation can be defined as the coating of solids, liquids or gases with a protective wall or shell. The wall or shell is usually composed of polymeric materials, although fats and waxes can also be used. The capsule can be a matrix or lozenge capsule. A lozenge capsule has a complete shell around the core material without holes or pores that expose the core or core material to the environment. A matrix capsule is a random mixture of core and shell material with no specific or defined coating. In effect, a matrix capsule is a homogeneous mixture of core and shell material.

A general review of encapsulation techniques can be found in "Micro encapsulation: Methods and Industrial Applications", edited by Simon Benita (Published by Marcel Dekker, Inc.).

Interfacial Complexation

This is a technique to produce matrix capsules or filaments using a natural polysaccharide, e.g. sodium alginate, as the binder material and replacing the sodium cation with a divalent calcium cation to produce calcium alginate, which is insoluble in water, thereby producing a matrix particle. If a flavour is mixed with the sodium alginate, when the calcium/sodium ion exchange occurs the whole system becomes cross-linked and traps the flavour within the molecular structure of the newly formed calcium alginate. The form of the insoluble alginate can be either filaments (threads) if extruded into a bath, or capsules (beads), if extruded using a vibrating nozzle head, such as in the Brace encapsulation process.

Capsules produced for this study were prepared by using a 6% w/w solution of sodium alginate (Kelgin LV ex ISP Alginates) dissolved in distilled water at 45-50° C. whilst mixing using a high sheer impeller paddle on an overhead mixer. Once a true solution had been formed a 6% w/w addition of the flavour was emulsified into the solution with the feed stock being kept at 45-50° C. during all processing.

A suitable strength gelling solution was prepared, for example, 6% calcium chloride solution w/w produced with distilled water. The strength of the setting solution and the salt may vary according to the gellation required.

To produce the capsules the feed stock was fed through a pressurised system to the vibrating nozzle, which breaks up the streams of feedstock to form droplets. The resulting droplets fall into the salt solution to form the matrix capsules, which are then harvested, washed with water and mobile dried.

The filaments or threads were produced by extruding the sodium alginate and flavour mixture into a bath of the salt solution and allowed to set for a minimum of 90 seconds. The thread was then washed with water and dried at room temperature under tension, (i.e. wound around a drum).

Table 1 shows the samples produced by interfacial complexation with varying cation types, geometry and flavours used. The percentage core content and moisture content are also shown in the table.

All samples were produced with sodium alginate as the binder, then converted with the cation shown in Table 1 below. The capsules and filaments show "pockets" of flavour within the cross-lined alginate shell material.

TABLE 1

| Sample No. | Cation | Salt Strength (%) | Physical form | Flavour | % core | % moisture |
|---|---|---|---|---|---|---|
| 1 | $CaCl_2$ | 6 | Capsule | γ undecalactone | 0.77 | 27.85 |
| 2 | $CaCl_2$ | 6 | Thread | γ undecalactone | 1.89 | 13.97 |
| 3 | CaAc | 6 | Capsule | Spearmint oil | 23.04 | 17.78 |
| 4 | $CaCl_2$ | 6 | Capsule | Spearmint oil | 26.92 | 13.51 |
| 5 | Cu | 10 | Capsule | Spearmint oil | 14.01 | 19.32 |
| 6 | V | 10 | Capsule | Spearmint oil | 13.89 | 16.06 |
| 7 | Zn | 10 | Capsule | Spearmint oil | 24.29 | n/d |
| 8 | Al | 10 | Capsule | Spearmint oil | 5.5 | n/d |
| 9 | Al | 10 | Capsule | Peppermint oil | n/d | n/d |
| 10 | V | 10 | Capsule | Peppermint oil | n/d | n/d |
| 11 | CaAc | 6 | Capsule | Peppermint oil | n/d | n/d |
| 12 | $CaCl_2$ | 6 | Capsule | Peppermint oil | n/d | n/d |
| 13 | Zn | 10 | Capsule | Peppermint oil | n/d | n/d |
| 14 | Cu | 10 | Capsule | Peppermint oil | n/d | n/d |
| 15 | $CaCl_2$ | 6 | Thread | Spearmint oil | 4.56 | 14.96 |
| 16 | $CaCl_2$ | 6 | Thread | Peppermint oil | 8.74 | 14.45 |

Molecular Entrapment

This is a technique to trap flavour molecules within a molecular cavity within the micromolecule, where the flavour is held by weak forces, i.e. van der Waal or hydrogen bonding. Two different molecules of different sized molecular cavities were evaluated, namely zeolite and β-cyclodextrin. Two zeolite molecules were evaluated, a more conventional type and a more hydrophobic type.

The flavours were trapped into the macromolecules by mixing the macromolecule in distilled water to form a 12% dispersion. An equal amount of flavour (12% wt/wt) was added to the system whilst mixing with an overhead mixer fitted with an impeller blade. The slurry was then filtered under vacuum and the solid collected. The sample was then mobile dried until a dry powder had formed.

The samples shown in Table 2 were produced by this method. The resulting core and mixture content of the capsules are also shown.

TABLE 2

| Code | Macromolecule | Flavour | % core | % moisture |
|---|---|---|---|---|
| 17 | β cyclodextrin | γ undecalactone | 34.18 | 7.48 |
| 18 | Zeolite | γ undecalactone | 0.65 | 13.19 |
| 19 | Zeolite (hydrophobic) | Peppermint oil | n/d | 4.39 |
| 20 | Zeolite (hydrophobic) | Spearmint oil | 10.43 | 2.88 |
| 21 | Zeolite | Spearmint oil | n/d | 15.67 |
| 22 | β cyclodextrin | Spearmint oil | 3.15 | 12.26 |
| 23 | β cyclodextrin | Peppermint oil | 8.77 | n/d |
| 24 | Zeolite | Peppermint oil | 9.02 | 10.96 |

Complex Coacervation

Two chemical variations can be classified under this technique, namely gelatine (type A) and non-gelatine (type B) systems.

Type A

The gelatine system involves phase separation of two natural polymers, gelatine and gum Arabic, which separations is achieved by altering the charge on the gelatine reduction. Once the two polymer materials are oppositely charged (gelatine cationic and gum Arabic anionic) they react to form a liquid phase around a core particle, i.e. a lozenge capsule. This occurs under very specific temperature, dilution and pH conditions. This liquid/liquid phase separation can be made irreversible by using a di-aldehyde to crosslink the —COOH from the gum Arabic and —$NH_2$ functional groups on the gelatine polymers to form the solid capsule wall. The process takes place at less than 10° C. and over 12 hours. If no crosslinking takes place the liquid shell around the core particle can be removed easily by increasing the pH and temperature. The final stage of the process is to de-water the walls of the capsules.

The capsules for this study were made by mixing 72 g of a 10% gum Arabic solution at pH 6 and 72 g of a 10% gelatine solution together using an overhead stirrer and high sheer paddle and heated to 60° C., 40 g of the flavour and 260 g distilled water were emulsified into the mixture and heated to maintain the temperature at 60° C. The stirrer speed was then set to form an emulsion of the required particle size for the final capsules. When the temperature of the mixture was at 60° C. the heat source was removed and the solution allowed to cool slowly to room temperature. The pH of the mixture was then reduced using 20% w/w acetic acid until a "halo" effect could be seen around the core materials using a microscope.

Once the halo was present the mixture was then cooled via a chilled bath to <10° C. before 3 ml of 50% gluteraldehyde was added. The solution was then allowed to mix for 15 hours at <10° C.

After the crosslinking had occurred the mixture was heated to 60° C. for 30 minutes to de-water the shells of the capsules. The mixture was then cooled to room temperature before isolation by vacuum filtration.

Type B

The non-gelatine process uses synthetic polymers and monomers to produce capsules that are a mixture of lozenge and matrix.

Polyvinyl alcohol, boric acid, gum Arabic and two different salt solutions (sodium and vanadyl sulphate) are combined to produce capsules within 4 hours.

The rate of reaction is controlled by the formation of the borate ester, which prevents the boric acid and polyvinyl alcohol reacting on contact. The phase separation of the polymers is controlled by the addition of the salt solutions rather than by changing the pH and the hardening and de-watering stage is controlled by the two different salt solutions.

The capsules for this study were made by preparing a cyclic borate ester; 5.2 g of boric acid was mixed with 9.9 g of 2-methyl-2,4, pentanediol in 100 g of distilled water at 45° C. for 1 hour. By using an ester the boric acid is prevented from reacting instantly with the polyvinyl alcohol (PVOH). To the ester, 150 g of a 5% w/w solution of PVOH, (a mixture of low and high molecular weight polymers was used) was added. 10 g of urea, 200 ml of 11% gum arabic solution, at pH6, and 50 g of the flavour were then added.

The mixture was emulsified with an overhead stirrer and high sheer paddle. The speed was set to form the emulsion particle size required for the final capsule size.

160 g of 15% sodium sulphate was added whilst mixing, then 10 g of 7.5% vanadyl sulphate and 5% sodium sulphate at pH 4.5; the salts caused the monomers and polymers to crosslink and gel. The capsules were left to mix for 1 hour before isolating by centrifuge and mobile drying.

Details of the samples prepared by complex coacervation are shown in Table 3 along with the resulting core and moisture content of the capsules.

TABLE 3

| Code | Type | Flavour | % core | % moisture |
|---|---|---|---|---|
| 25 | B | γ undecalactone | 44.04 | 2.46 |
| 26 | A | γ undecalactone | 51.06 | 3.69 |
| 27 | B | Spearmint oil | 10.30 | 5.86 |
| 28 | B | Peppermint oil | 52.20 | 3.37 |
| 29 | A | Peppermint oil | n/d | 9.02 |
| 30 | A | Spearmint oil | 1.08 | 12.58 |

Preferential Precipitation

The preferential precipitation technique exploits polymeric material that can be gelled or precipitated by either salts or non-solvents to produce capsules that can be isolated and processed.

The main polymeric material used for the production of capsules by this technique is co-polyacrylamide-acrylate, which can be precipitated with the sulphate salts of vanadium or aluminum. The cation forms a complex with the polymer materials and links the functional groups in a solid matrix. The strength of the capsule is related to the gel strength of the matrix formed, i.e., the type of cation in the salt solution. The capsules produced are a mixture of both matrix and lozenge type capsules.

The capsules for this study were produced by emulsifying 25 g of the flavour into 92 g Alcapsol 144 (trade name for co-polyacrylamide/acrylate supplied by Allied Colloids) using an overhead stirrer and high sheer paddle. The emulsion was then heated to 45° C., then cooled to <10° C. 151 g of distilled water at <10° C. was then added and the pH adjusted to 12.5 with 40% sodium hydroxide.

72 g of 20% aluminum sulphate solution was added over 5 minutes to form the capsules and the solution was allowed to mix for 30 minutes before isolating via vacuum filtration and mobile drying. Sample formulation details and the resulting core and moisture content are shown in Table 4. The capsules produced were a mixture of matrix and multicore type capsules.

TABLE 4

| Code | Cation | Flavour | % core | % moisture |
|---|---|---|---|---|
| 31 | Al | γ undecalactone | 4.28 | 22.9 |
| 32 | V | γ undecalactone | 9.70 | 21.82 |
| 33 | Al | Spearmint oil | 6.53 | 18.29 |
| 34 | Al | Peppermint oil | 12.88 | 19.76 |
| 35 | V | Peppermint oil | n/d | n/d |
| 36 | Cu | Peppermint oil | n/d | n/d |
| 37 | V | Spearmint oil | n/d | n/d |
| 38 | Cu | Spearmint oil | 7.12 | n/d |

Interfacial Polymerisation

Interfacial polymerisation technology utilises monomeric materials to produce a polymer at an oil/water interface. The polymers produced can vary and materials such as polyamides, polyurathanes, polyisocyanates and polyesters can be produced. The core material, which was dispersed/dissolved in the oil soluble monomer, is emulsified in water, which can be stabilised with surfactants if required. The particle size of the capsules is determined by the size of the droplets in the discontinuous phase produced by the emulsification step. The second monomer is added to the reaction mixture in the continuous phase and a polymerisation reaction will take place between the two monomers at the oil/water interface.

The wall thickness of the polymeric shell around the flavour is determined by the rate of migration of the monomers through the membrane produced by the polymerisation reaction. The monomer migration through the polymer shell determines the capsule shell thickness as eventually no further reaction between the two monomers can occur. The resulting lozenge type capsules then release their core material by either permeation or rupture.

Capsules for this study were produced by forming an emulsion with 500 g of distilled water and 40 g of the flavour which contained and 2.6 g of sebacoyl chloride using an overhead mixer and high sheer paddle. 10.4 g hexadiamine in 40.4 g distilled water was added to the mixture over 10 minutes and this was allowed to mix for 45 minutes before isolating via vacuum filtration and mobile drying.

Formulation details for this process are shown in Table 5 along with the resulting core and moisture contents of the capsules

TABLE 5

| Code | Polymer formed | Flavour | % core | % moisture |
|---|---|---|---|---|
| 39 | Amide | γ undecalactone | Did not produce capsules | |
| 40 | Amide | γ undecalactone | | |
| 41 | Amide | Peppermint oil | n/d | n/d |
| 42 | Amide | Spearmint oil | 14.86 | n/d |
| 43 | Amide | Spearmint oil | n/d | n/d |
| 44 | Amide | Peppermint oil | n/d | n/d |

Melt/Wax Coating

The flavour is mixed with a molten material such as a fatty acid or paraffin wax by emulsifying the molten binder and flavour together in water above the melting point of the shell material. The water is then cooled and the flavour and binder allowed to solidify together. This causes a blend or matrix to be formed with the flavour trapped in a solid form throughout the capsule.

The capsules for this study were produced by heating an emulsion of 13.5% w/w palmitic acid in distilled water to 65° C. using an overhead stirrer with a high shear paddle. 25% w/w of the flavour compared to the palmitic acid was added to the mixture, which was then allowed to cool slowly until solid capsules formed. The capsules were isolated by filtration and dried in a dessicator.

Formulation details of the capsules are shown in Table 6 along with the core and moisture content of the capsules.

TABLE 6

| Code | Coating | Flavour | % core | % moisture |
|---|---|---|---|---|
| 45 | Palmitic acid | γ undecalactone | 23.93 | 0.24 |
| 46 | Paraffin wax | γ undecalactone | 14.99 | 1.49 |
| 47 | Palmitic acid | Peppermint oil | n/d | 0.3 |
| 48 | Palmitic acid | Spearmint oil | n/d | n/d |

The capsules produced using the palmitic acid showed a more robust form, as the melting point of the paraffin wax was below 50° C. A solid matrix capsule was produced.

Spray Drying

Spray drying is the oldest technology within the encapsulation area developed in the 1930's. The technique uses an emulsion formed with a low viscosity water soluble polymer and a core material, which is atomised through a nozzle, into a drying chamber that is heated to over 150° C. The water is almost instantly evaporated, and the dry matrix particle is carried through the system and separated via a cyclone for collection. The residence time within the whole processing system would be less than 2 seconds.

The capsules for this study were produced using a 10% w/w solution of gum arabic in distilled water. 10% w/w of the flavour was then emulsified into the polymer solution to form the feed stock.

The spray drier was heated so the inlet temperature was above 150° C. and the outlet temperature was approximately 70° C. The systems temperatures were stabilised by spraying distilled water through the nozzle into the drying chamber. The flavour emulsion was sprayed through an atomised nozzle using the automatic nozzle cleaner.

The powder capsules were collected once the spraying of the emulsion had been completed and the system had cooled to below 50° C.

Formulation details for samples produced by spray drying are shown in Table 7. Core and moisture contents are also shown. All of the samples used Gum Arabic as the binder.

TABLE 7

| Code | Flavour | % core | % moisture |
|---|---|---|---|
| 49 | γ undecalactone | 2.19 | 11.85 |
| 50 | Peppermint oil | n/d | 13.65 |
| 51 | Spearmint oil | n/d | 15.64 |

In-Situ Polymerisation

The in-situ polymerisation technique can be classed as a cross between the interfacial polymerisation and precipitation reactions. A mixture of both monomers and polymers are used to form the shell material around the substrate, and a multi-core capsule often results. The resulting polymeric material can then either be cross-linked using multivalent salts or by using cross-linking agents such as dialdehydes. The polymeric materials used in the process are long chain alcohols, which can be crosslinked readily, the monomers used can be di-functional alcohols and amines. The preformed polymeric material acts as a plasticiser in the final capsule wall.

The capsules for this study were produced by adding 100 g of a 1% high molecular weight and 4% of a low molecular weight PVOH solution to 188 g of distilled water with 1.88 g urea and 7.5 g resorcinol. The mixture was heated to 45° C. whilst mixing with a high sheer impeller mixer. 30 g of the flavour was added and the pH of the mixture was reduced to 1.7 with 10% sulphuric acid.

57 g of a 25% solution of gluteraldehyde was added over a 90 minute period during which time precipitation occurred. The mix was heated to 55° C. for 2 hours 30 minutes prior to the pH being increased to 4.5 with a 40% sodium hydroxide solution. The product was filtered under vacuum and mobile dried.

Formulation details for the production of capsules by in situ polymerisation are shown in Table 8. The core and moisture content of the multi-core capsules are also shown.

TABLE 8

| Code | Crosslinking agent | Flavour | % core | % moisture |
|---|---|---|---|---|
| 52 | Salts | γ undecalactone | 39.24 | 2.55 |
| 53 | Gluteraldehyde | γ undecalactone | 30.59 | 2.04 |
| 54 | Salts | Peppermint oil | 40.57 | 4.32 |
| 55 | Salts | Spearmint oil | 44.68 | 3.41 |

Agglomeration

Agglomeration is a simplistic method of converting a liquid material into a solid matrix through mechanical processing. The process yields capsules with exposed core material on the surface of the granule or particle, due to the flavour being mixed with a solid substrate, which either absorbs it or leaves the liquid coating the surface. This material can then be further coated with a binder, which coats the substrate, and also sticks the particles together to increase the overall particle size. The liquid flavour is absorbed onto or into a substrate which undergoes mechanical action to increase the particle size using a binder material which also coats the surface of the substrate, thus offering some protection of the flavour from the immediate storage environment.

A food processor with metal mixing blades was used for all capsule formation.

200 g of the solid substrate material (e.g. Zeolite) was placed into the mixing bowl with 18 g of the solid binder material (eg. Carboxymethyl cellulose CMC). Switching the mixer on for 10 seconds mixed the powders. The liquid binder or water was then added to the powders, whilst mixing, in a steady flow until the required particle size was reached. The powders were removed from the mixing bowl sporadically to evaluate the size and to prevent segregation of the product. The agglomerates were then mobile dried.

Formulation details for samples produced by agglomeration are shown in Table 9, along with the core and moisture contents.

TABLE 9

| Code | Substrate | Binder | Flavour | % core | % moisture |
|---|---|---|---|---|---|
| 56 | Zeolite | CMC | γ undecalactone | 14.90 | 13.17 |
| 57 | Zeolite | Palmitic acid | γ undecalactone | 13.56 | 3.75 |
| 58 | β cyclodextrin | CMC | γ undecalactone | 17.08 | 10.02 |

Commercial samples from Mane Flavour House were obtained for evaluation against the encapsulated samples produced in-house. Sample details are shown in Table 10.

TABLE 10

| Code | Encapsulation type | Flavour | % core | % moisture |
|---|---|---|---|---|
| 59 | Spray Dried | Peppermint | n/d | n/d |
| 60 | Agglomeration maltodextrin | Peppermint | 1.32 | n/d |

EXAMPLE 2

Cigarette Design Evaluation

In order to determine whether the position of the aroma site would have an effect on flavour delivery to the sidestream, several cigarette design experiments were undertaken.

Gamma undecalactone was used as the model compound to establish whether an effect was evident. Analysis was performed within two hours of cigarette preparation.

The following cigarette designs were evaluated:

A Flavour injected directly onto the outside of the cigarette paper (8.5)

B Flavour injected onto the tobacco (8.5)

C Flavour thread, produced by interfacial complexation, inserted into the tobacco rod (9.6)

D Flavour thread, produced by interfacial complexation, placed between the paper in a dual wrap configuration (9)

E1/E2 Coaxial cigarettes with the flavour either on the inner or the outer tobacco blend, using the same tobacco blend in both sections (5.7/5.7)

F1/F2 Coaxial cigarettes with the flavour either on the inner or the outer tobacco blend, using different tobacco blends in each section (14/14)

G Polymer film stabilised flavour applied to the outside surface of the paper in a conventional configuration (11)

H Flavour in contact with a burn additive applied to the outside surface of the paper in a conventional configuration (7.7).

The numbers in brackets after the descriptions in the above list are puff numbers.

The effectiveness of each of the designs was determined against the chemically stabilised gamma decalactone sample described above, which gave a sidestream to mainstream flavour delivery ratio of 3:1.

The sidestream to mainstream ratios (SS:MS) of gamma undecalactone in the particulate phase are shown graphically in FIG. 1. The actual ratios for each arrangement are given above the columns.

From the initial results it was clear that the site of the aroma chemical had a significant effect on the level delivered to both the sidestream and the mainstream.

The dual wrapped cigarette with the flavour thread between the papers was found to give the greatest increase in the sidestream to mainstream (SS:MS) flavour delivery ratio of gamma undecalactone over the control cigarette.

The permeability of the outer paper wrap in the dual wrap configuration was also found to affect the SS:MS ratio. When porous plug wrap with a net permeability of over 6,000 C.U. was used, a SS:MS ratio of 13:1 was achieved. When a highly porous cigarette paper with a net permeability of 600 C.U. was evaluated using the same stabilised flavour, the SS:MS flavour delivery ratio was reduced to 11:1. These results indicate that the higher the porosity of the outer wrap in the dual wrap configuration, the more of the aroma compound will be delivered into the SS smoke. This structure is, surprisingly, in direct contrast to that described in U.S. Pat. No. 5,494,055.

EXAMPLE 3

Given the results of this cigarette design evaluation, all subsequent smoke analysis was performed on dual wrapped cigarettes with the capsules placed between the two wrappers. All of the gamma undecalactone samples used porous plug wrap as the outer paper to enable the optimum flavour delivery to the sidestream smoke.

Further encapsulation work on the peppermint and spearmint aromas was performed. A highly porous cigarette paper was used as the outer wrap, which had a net porosity of 600 C.U. with natural and electrostatic perforations.

Capsule Performance

Capsules representative of the techniques used (see Table 11 below) that gave the best results were further assessed, in a dual wrap configuration, to determine how suitable they were at delivering the flavour preferentially to the sidestream smoke. This was determined by performing mainstream and sidestream particulate phase smoke analysis on the cigarettes using standard BAT methodologies on a Filtrona smoking engine (smoking under standard machine smoking conditions of 35 $cm^3$ puff of 2 seconds duration taken every minute). The fishtail apparatus described in Analyst, October 1988 Vol. 113 pp 1509 was used for sidestream analysis. The mainstream to sidestream flavour delivery ratio was determined for each flavour and capsule type using GC calibration curves for standard solutions of the marker compounds, (gamma undecalactone, L-carvone and menthol) of each flavour, calculating the amount and percentage of each marker compounds in the original oils to produce a factor (F) derived from the percentage menthol in peppermint and the percentage L-carvone in spearmint oil. The factor (F) is used to calculate the percentage of encapsulated peppermint or spearmint from the amount of menthol or L-carvone in an extract of the flavour obtained from a fixed weight of granules.

TABLE 11

| Sample No. | Core Material | Encapsulation system |
|---|---|---|
| 1 | γ undecalactone | Complexation/Thread/Ca cation |
| 2 | γ undecalactone | Complexation/Beads/Ca cation |
| 37 | Spearmint | Complexation/Beads/Cu cation |
| 8 | Spearmint | Complexation/Beads/Al cation |
| 7 | Spearmint | Complexation/Beads/Zn cation |
| 3 | Spearmint | Complexation/Beads/CaAc |
| 6 | Spearmint | Complexation/Beads/V cation |
| 4 | Spearmint | Complexation/Beads/Ca cation |
| 5 | Spearmint | Complexation/Beads/Cu cation |
| 12 | Peppermint | Complexation/Beads/Ca cation |
| 15 | Spearmint | Complexation/Thread/Ca cation |
| 16 | Peppermint | Complexation/Thread/Ca cation |
| 17 | γ undecalactone | Entrapment/β cyclodextrin |
| 22 | Spearmint | Entrapment/β cyclodextrin |
| 20 | Spearmint | Entrapment/Zeolite (hydrophobic) |
| 21 | Spearmint | Entrapment/zeolite |
| 24 | Peppermint | Entrapment/Zeolite |
| 26 | γ undecalactone | Complex coacervation type A |
| 25 | γ undecalactone | Complex coacervation type B |
| 27 | Spearmint | Complex coacervation type B |
| 28 | Peppermint | Complex coacervation type B |
| 30 | Spearmint | Complex coacervation type A |
| 31 | γ undecalactone | Preferential precipitation/Al cation |
| 32 | γ undecalactone | Preferential precipitation/V cation |
| 38 | Spearmint | Preferential precipitation/Cu cation |
| 33 | Spearmint | Preferential precipitation/Al cation |
| 34 | Peppermint | Preferential precipitation/Al cation |
| 42 | Spearmint | Interfacial polymerisation |
| 45 | γ undecalactone | Wax coating |
| 49 | γ undecalactone | Spray drying |
| 59 | Peppermint | Spray dried/commercial sample |
| 52 | γ undecalactone | In situ polymerisation |
| 53 | γ undecalactone | In situ polymerisation |
| 55 | Spearmint | In situ polymerisation |
| 54 | Peppermint | In situ polymerisation |
| 56 | γ undecalactone | Agglomeration/CMC & zeolite |
| 57 | γ undecalactone | Agglomeration/Wax & zeolite |
| 58 | γ undecalactone | Agglomeration/CMC & β cyclodextrin |
| 60 | Peppermint | Agglomeration/commercial sample |

A range of capsule inclusion levels were also evaluated. The capsules which were analysed all contained varying levels of the core material (see percentage core material in each of Tables 1-10). In order to ensure that the amount of flavour added to the cigarettes was constant, varying levels of capsules were added.

Gamma Undecalactone

Standard State Express 555 cigarettes were double wrapped with porous plug wrap (6,000 CU) as the outer paper, the inner wrap being 50 CU. The capsules to be evaluated were placed between the two papers. The capsules were added at a flavour level of 4000 ppm. This flavour level is readily measured on a GC mass spectrometer.

The natural SS:MS flavour delivery ratio for gamma undecalactone when applied to cigarette paper is 6:1 and the SS:MS flavour delivery ratio for gamma undecalactone when converted to the potassium salt (chemically stabilised) and painted onto the paper is 3:1.

Figure 2:
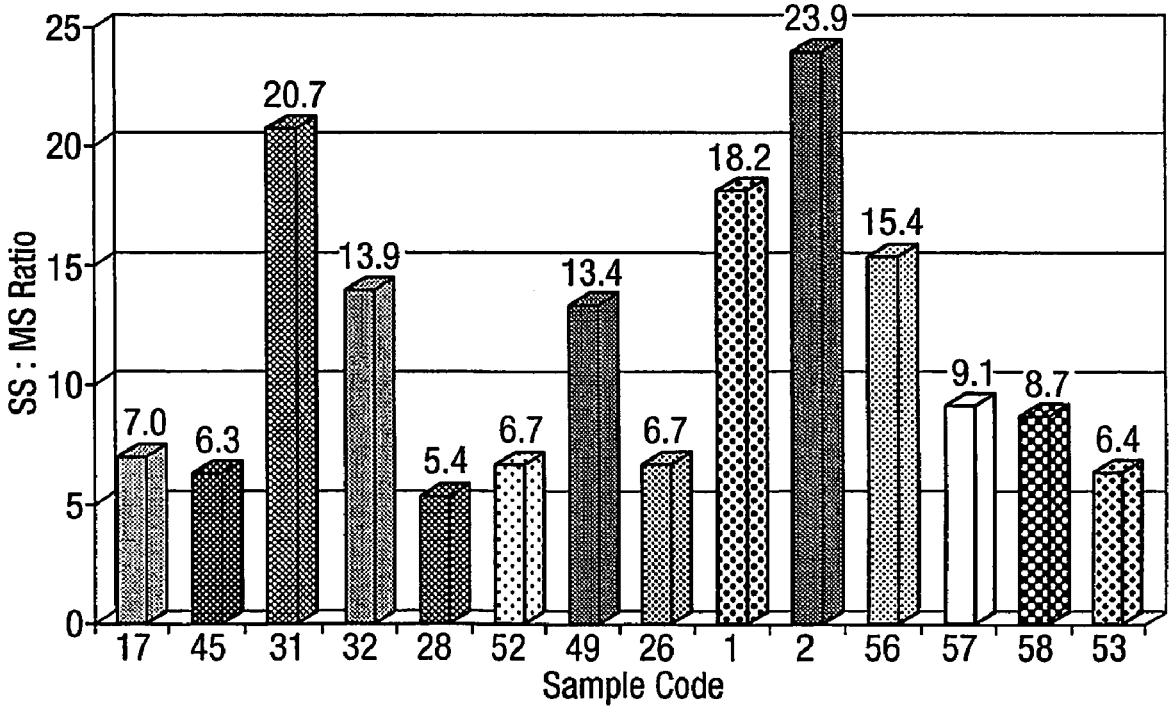
FIG. 2 shows the sidestream to mainstream flavour delivery ratio of gamma undecalactone with various capsule types in a double wrapped cigarette construction according to the invention.

FIG. 2 shows the sidestream to mainstream flavour delivery ratio for gamma undecalactone in the particulate phase for various capsule types, details of which types are shown in Table 11. It can be seen that all of the encapsulated samples show an improved distribution to the SS smoke compared to the chemically stabilised control sample. The sidestream to mainstream flavour ratios are given above the columns.

The capsules made using the interfacial complexation method (Sample No. 2) showed the greatest improvement over the natural ratio. The SS:MS flavour delivery ratio was 24:1. The flavour delivery ratio was reduced to 17:1 when filaments (Sample No. 1) were used rather than capsules. This is a result of the physical form of the sample and is not due to any chemical difference in processing.

Sample Nos. 31 and 32 were both manufactured using the preferential precipitation method of producing capsules, the only difference being the nature of the multivalent salt solution used during the processing. Sample No. 31 used $Al^{3+}$ and Sample No. 32 used $V^{4+}$ as the cationic species. The SS:MS flavour delivery ratios were 21:1 and 14:1 respectively. This difference illustrates the effect of gel strength which was altered by using cations which have different electrochemical strengths.

Other samples, which showed a large improvement over the 3:1 ratio of the chemically stabilised flavour, were Sample No. 49 a spray dried sample with a 13:1 SS:MS ratio, and Sample No. 56, an agglomerated sample with a 15:1 SS:MS ratio.

EXAMPLE 4

Standard State Express 555 cigarettes were double wrapped with porous cigarette paper (600 CU) as the outer paper and a 50 CU inner paper. The peppermint oil capsules to be evaluated were placed between the two papers. The capsules were added at a flavour level of 10000 ppm. This level was selected in view of measuring menthol, which is only present at about 50% of the peppermint flavour.

Figure 3:
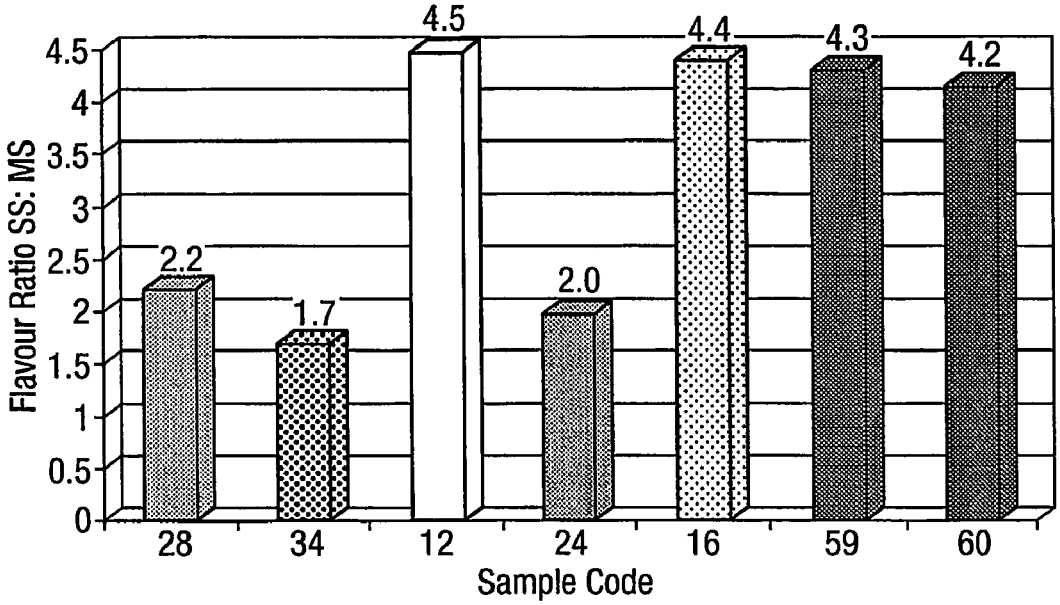
FIG. 3 shows the sidestream to mainstream flavour delivery ratio of peppermint oil with various capsule types in a cigarette according to the invention.

The natural SS:MS flavour delivery ratio of peppermint oil when applied to the surface of cigarette paper in a dual wrap configuration was 1.66:1. FIG. 3 shows the sidestream to mainstream flavour delivery ratios for the peppermint oil in the particulate phase for various capsule types. The sidestream to mainstream ratios are shown above each column. The capsules produced by interfacial complexation using calcium chloride as the gelling agent (Sample No. 12) showed the most significant increase in the sidestream to mainstream flavour delivery ratio with a ratio of 4.5:1 being achieved. The two commercial samples (Sample Nos. 59 and 60) and Sample No. 16 (complexation thread) also delivered a higher level of peppermint into the sidestream than the natural SS:MS distribution achieved when the flavour is painted directly onto the cigarette paper.

EXAMPLE 5

Standard State Express 555 cigarettes were double wrapped with porous cigarette paper (600 C.U.) as the outer paper on a 50 CU inner paper. The spearmint oil capsules to be evaluated were placed between the two papers. The capsules were added at a flavour level of 10000 ppm.

Figure 4:
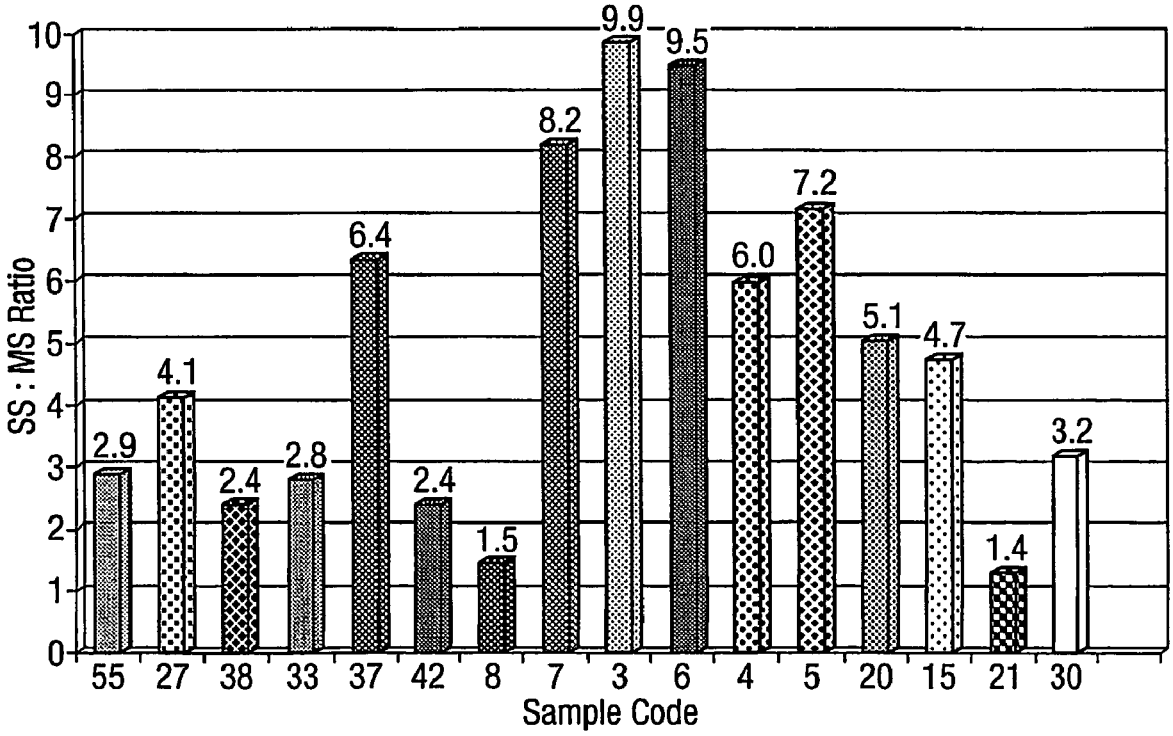
FIG. 4 shows the sidestream to mainstream flavour delivery ratio of spearmint oil with various capsule-types in a cigarette according to the invention.

The natural SS:MS distribution of the spearmint oil flavour when applied to the paper of the outer wrap was 1.74:1. FIG. 4 shows the sidestream to mainstream flavour delivery ratios for the spearmint oil in the particulate phase for various capsule types. The sidestream to mainstream ratios are shown above each column.

The capsules produced by the interfacial complexation method with calcium acetate as the gelling agent (Sample No. 3) showed the most significant increase in the SS:MS flavour delivery ratio, a ratio of 9.86:1 was achieved. A range of capsules produced by interfacial complexation were assessed with different cations used as the gelling agent. The performance of these capsules in delivering the flavour to the SS varied depending on the cation used, the calcium, zinc and vanadium cations performed better than the copper and aluminium cations. The physical form of the complexed alginate did not affect the ratio of flavour delivered as the thread and capsules produced with calcium chloride as the gelling agent both delivered a SS:MS ratio between 4.5 and 6:1.

The capsules produced by molecular entrapment using zeolite as the macromolecule performed differently. The hydrophobic zeolite sample (Sample No. 20) delivered a higher amount of flavour to the sidestream than the standard zeolite sample (Sample No. 21).

EXAMPLE 6

In order to detect the effect the enhanced gamma undecalactone flavoured sidestream smoke had on relatively fresh sidestreamn smoke, the room used for this evaluation were held at constant humidity and temperature throughout the assessments. State Express 555 cigarettes in a dual wrap configuration with porous plug wrap as the outer wrap were used with varying levels (600-1500 ppm) of the gamma undecalactone added to the inner paper surface. One cigarette per booth was smoked.

The smoke was aged for 60 minutes prior to panellist assessment to ensure that the levels of irritation and smoke impact were not overpowering to the panellists. Each panellist assessed three booths per session.

The control cigarettes for the experiment were a dual wrapped State Express 555 with no flavour added, and a dual wrapped State Express 555 with 1500 ppm of the chemically stabilised gamma undecalactone added to the outer wrap.

Figure 5:
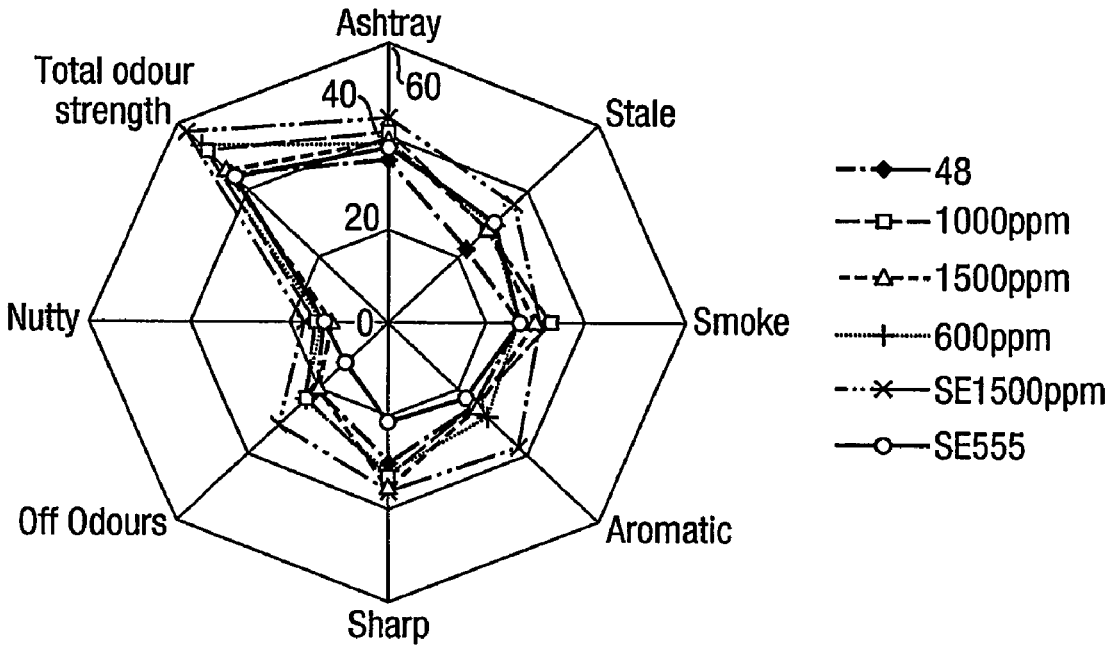
FIG. 5 is a space map depicting the difference between the attributes for aged sidestream smoke by residual odour on cloth.

It can be seen from FIG. 5 that no statistically significant results were found between the samples when the aged sidestream smoke was assessed. The comments from the panellists indicated that the peach odour could be detected when added to the paper at a level of 600 ppm; the odour was found to be unpleasant in most cases.

Although no statistical data was obtained from this experiment, from the panellists' comments the panel leader was confident that the panellists could detect the y undecalactone odour at 600 ppm in a statistically relevant test.

EXAMPLE 7

The rooms used for this evaluation of peppermint and spearmint oils were held at constant temperature and humidity throughout the assessments. Control menthol lights cigarettes in a dual wrapped configuration with a porous paper having no flavour applied thereto as the outer wrap were used, with the aroma added to the outer paper surface at varying levels. Six cigarettes per room were smoked.

The smoke was aged for 40 minutes prior to panellist assessment and each panellist assessed two rooms per session with one room always containing smoke from the control cigarette. Paired comparison statistical analysis was performed on the data for each session.

Figure 6:
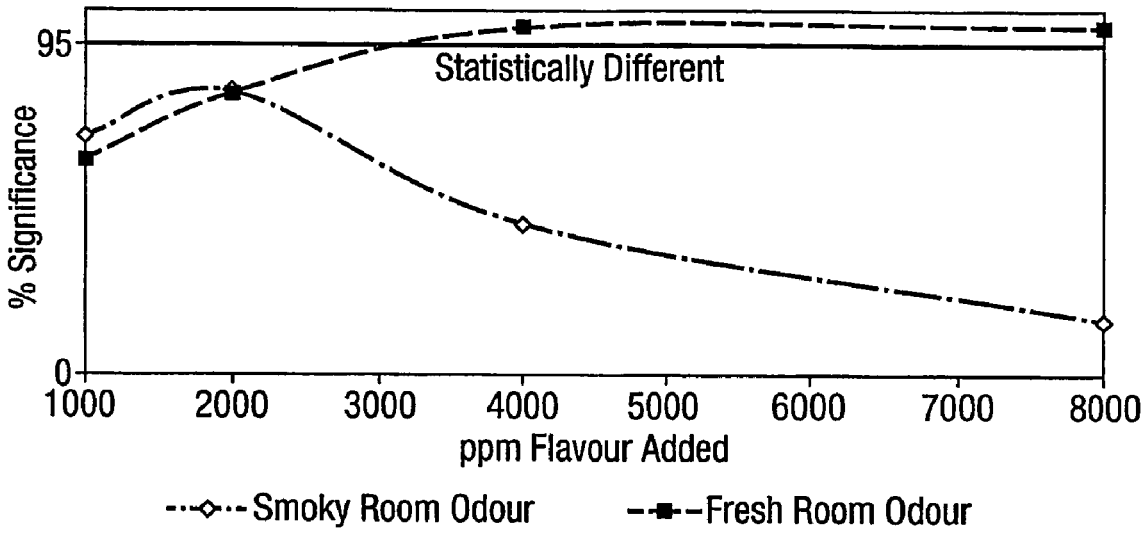
FIG. 6 shows the analysis of room aroma for spearmint oil aroma under fresh room odour conditions and smoky room odour conditions.

Statistical analysis of the results, as shown in FIG. 6 show that a significantly fresher room is perceived at spearmint oil addition levels of 4000 ppm and above. The actual detection level would lie somewhere between 2000 and 4000 ppm. Further sensory analysis would be required to obtain the actual detection level.

Figure 7:
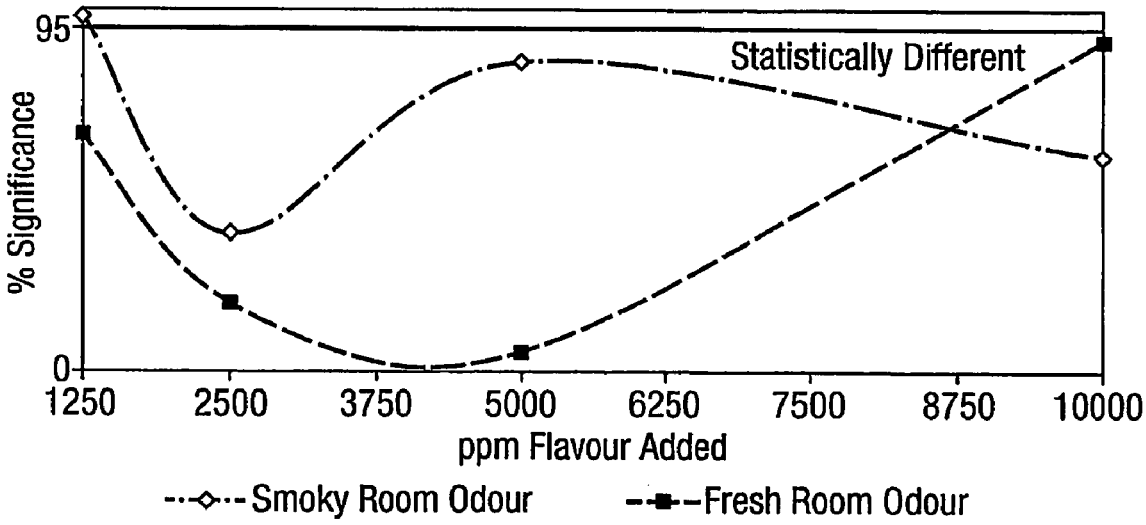
FIG. 7 shows the analysis of room odour for peppermint oil aroma under fresh room odour conditions and smoky room odour conditions.

Statistical analysis of the results, shown in FIG. 7, show that a significant result for a fresher room has not been established at the levels evaluated. The results suggest that more than 10,000 ppm peppermint oil would be required to give the room odour a perceived freshness.

EXAMPLE 8

The effectiveness of the SS:MS ratio required to give a perceived sensory fresh room without affecting mainstream taste was evaluated, so that the minimum SS:MS ratio could be determined.

Gamma Undecalactone

A paired comparison of cigarettes with varying levels of gamma undecalactone in propylene glycol solvent injected into the tobacco was performed. Statistical analysis of the results is shown in FIG. 8.

Figure 8:
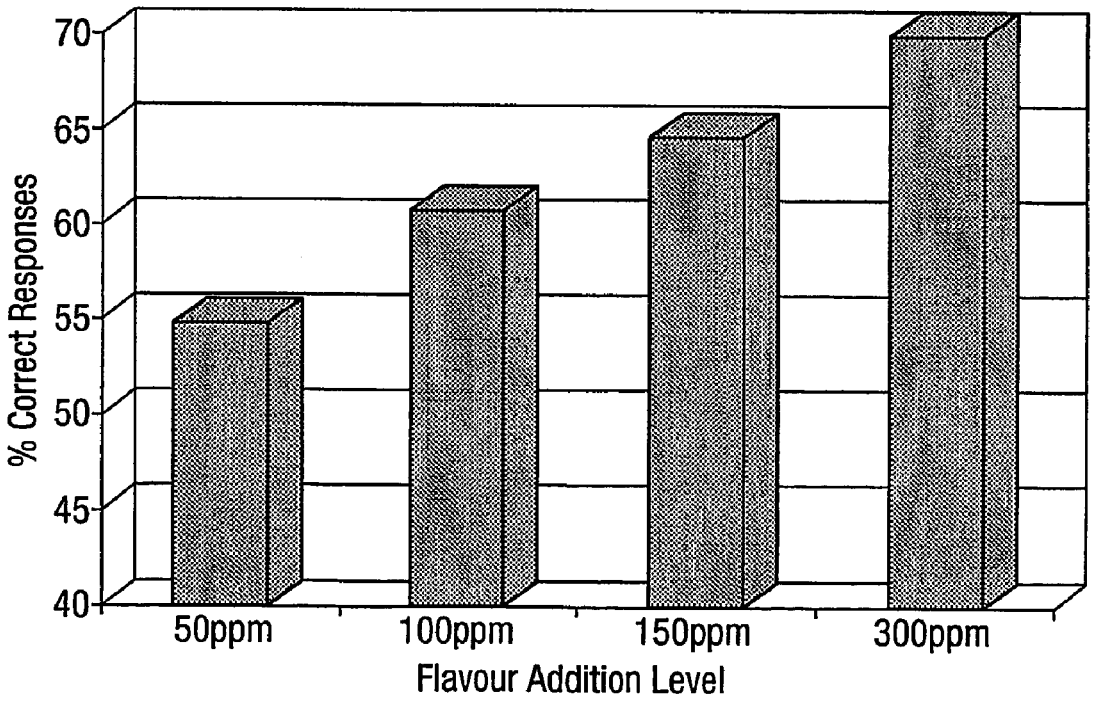
FIG. 8 shows the statistical results of mainstream smoke sensory analysis for gamma undecalactone.

From FIG. 8 it can be seen that at a flavour level of 300 ppm 70% of the panellists gave a correct response (21 out 30), which was considered to be statistically significant. Panellists found the samples to have a higher flavour intensity and strength than the control.

At a flavour addition level of 150 ppm, statistically there was no significant difference between the cigarettes but the panellists found the flavoured cigarette to be harsher at 90% confidence level than the control cigarette.

At a flavour addition level of 100 and 50 ppm no statistically significant difference was found between the control and sample cigarette. However, both levels were considered to have higher flavour intensity at 90% confidence level.

From sensory evaluation a sidestream to mainstream flavour delivery of 6:1 would achieve the delivery of the sidestream aroma without affecting the mainstream taste of the cigarette.

The model system also proved that the delivery of an aroma to the sidestream smoke could be achieved without affecting the mainstream taste of the cigarette.

Spearmint Oil

The statistical differences between the control mentholated cigarette and the mentholated cigarettes with varying amounts of spearmint oil added were analysed and the results calculated.

At a flavour addition level of 15 ppm the panellists found an increase in menthol, warm, green and tobacco notes. The additional spearmint oil was found to have an effect at this level but it was not recognisable as a flavour. The spearmint oil flavour was recognised by the panellists at addition levels of 25 and 50 ppm. Both spearmint and green character had increased.

The detection level of the spearmint oil is deemed to be 25 ppm but a difference level of 15 ppm was found between the sample and the control cigarette.

From this sensory evaluation a sidestream to mainstream flavour delivery of 200:1 would achieve the delivery of the sidestream aroma without affecting the mainstream taste of the cigarette. The spearmint oil system as investigated would not be feasilble for the delivery of a fresh and minty aroma to the sidestream smoke as the mainstream taste of the cigarette would be affected.

Peppermint Oil

The statistical difference between the control mentholated cigarette with varying amounts of peppermint oil added were analysed and the results calculated.

The peppermint oil was found to merge with the menthol character of the cigarette at addition levels of 15 and 25 ppm and was perceived to have either an increase in peppermint character or a reduction in spearmint or green character.

At an addition level of 50 ppm the peppermint oil had the effect of reducing the vapourousness and menthol cooling character, the difference approaching the 95% significance level.

At an addition level of 100 ppm the sample was perceived to have a significant increase in peppermint character.

The detection level of peppermint oil in the mentholated product was 50 ppm but the difference level was at 25 ppm. From this sensory evaluation a sidestream to mainstream flavour delivery of greater than 400:1 would be required to achieve the delivery of the sidestream aroma without affecting the mainstream taste of the cigarette. The peppermint oil system as investigated would not be feasible for the delivery of a fresh and minty aroma to the sidestream smoke as the mainstream taste of the cigarette would be affected.

EXAMPLE 9

One way of overcoming the problem of the mainstream smoke being affected is to ventilate the cigarette. Ventilation reduces the detection level of the flavour in the cigarette which, in turn, alters the SS:MS ratio required to detect the flavour in the sidestream smoke.

The sidestream to mainstream delivery ratio was measured for State Express 555 and State Express 555 Lights. Spearmint oil was painted onto the outside of the cigarette paper. The ventilation level for the Lights product is 29%. The blends are similar. The sidestream to mainstream values were 1.6:1 for the conventional product and 2.13:1 for the Lights product.

A US blended product was also measured in the same way, spearmint oil being coated onto the outside of each product. A non-ventilated product gave a SS:MS ratio of 2.64:1, whereas a low tar delivery (2.8 mg) product with a 65% ventilation level gave a SS:MS ratio of 3.89:1.

Ventilation of these unencapsulated but flavour treated products clearly increases the SS:MS ratio obtained for each product.

The invention claimed is:

1. A smoking article having an enhanced delivery of flavour into the sidestream smoke, said smoking article comprising a rod of smoking material enwrapped in wrapper means, said wrapper means comprising two layers of wrapper material, and encapsulated flavour material being held between an inner and an outer layer of said wrapper means, said outer layer being a wrapper material having a total air permeability of at least 200 Coresta Units (C.U.), and being of a total air permeability greater than that of said inner wrapper means.

2. A smoking article according to claim 1, wherein said outer wrapper material has a total air permeability of at least 300 C.U.

3. A smoking article according to claim 2, wherein said outer wrapper material has a total air permeability of at least 500 C.U.

4. A smoking article according to claim 3, wherein said outer wrapper material has a total air permeability of at least 1,000 C.U.

5. A smoking article according to claim 4 wherein said outer wrapper material has a total air permeability of at least 6,000 C.U.

6. A smoking article according to claim 5, wherein said outer wrapper material has a total air permeability of at least 10,000 C.U.

7. A smoking article according to claim 1, wherein said inner wrapper means is an inner wrapper material having total air permeability in the range 25-150 C.U.

8. A smoking article according to claim 7, wherein said inner wrapper material has a total air permeability of 30-100 C.U.

9. A smoking article according to claim 8, wherein said inner wrapper material has a total air permeability of about 50 C.U.

10. A smoking article according to claim 1, wherein said encapsulated flavour material is in the form of a capsule or a thread.

11. A smoking article according to claim 1, wherein said encapsulated flavour material is produced using one or more of the following encapsulation techniques: interfacial complexation, molecular entrapment, complex coacervation, preferential precipitation, interfacial polymerisation, melt/wax coating, spray drying, in-situ polymerisation, agglomeration.

12. A smoking article according to claim 11, wherein said interfacial complexation uses a cation selected from the following: calcium acetate, $Al^{3+}$, $V^{4+}$, $Zn^{2+}$, $Cu^{2+}$, calcium chloride.

13. A smoking article according to claim 1, wherein said encapsulated flavour material comprises a volatile or semi-volatile flavourant.

14. A smoking article according to claim 13, wherein said encapsulated flavour material comprises any one or more of the following flavours: gamma undecalactone, peppermint oil, spearmint oil, menthol, vanillin, peppermint, spearmint, isopinocampheol, isomenthone, mint cooler, neomenthol, dill seed oil.

15. A smoking article according to claim 14, wherein said encapsulated flavour material comprises gamma undecalactone and is encapsulated by any one of the following methods: interfacial complexation, preferential precipitation, agglomeration, spray drying.

16. A smoking article according to claim 15, wherein said gamma undecalactone has a sidestream to mainstream flavour delivery ratio of at least 6:1.

17. A smoking article according to claim 16, wherein said gamma undecalactone has a sidestream to mainstream flavour delivery ratio of at least 10:1.

18. A smoking article according to claim 17, wherein said gamma undecalactone has a sidestream to mainstream flavour delivery ratio of at least 15:1.

19. A smoking article according to claim 18, wherein said gamma undecalactone has a sidestream to mainstream flavour delivery ratio of at least 20:1.

20. A smoking article according to claim 14, wherein said encapsulated flavour material comprises peppermint oil and is encapsulated by any one of the following methods: interfacial complexation, agglomeration, spray drying.

21. A smoking article according to claim 20, wherein said peppermint oil has a sidestream to mainstream flavour delivery ratio of at least 2:1.

22. A smoking article according to claim 21, wherein said peppermint oil has a sidestream to mainstream flavour delivery ratio of at least 4:1.

23. A smoking article according to claim 22, wherein said peppermint oil has a sidestream to mainstream flavour delivery ratio of at least 200:1.

24. A smoking article according to claim 14, wherein said encapsulated flavour material comprises spearmint oil and is encapsulated by any one of the following methods: interfacial complexation, molecular entrapment, complex coacervation.

25. A smoking article according to claim 24, wherein said spearmint oil has a sidestream to mainstream flavour delivery ratio of at least 4.5:1.

26. A smoking article according to claim 25, wherein said spearmint oil has a sidestream to mainstream flavour delivery ratio of at least 6:1.

27. A smoking article according to claim 26, wherein said spearmint oil has a sidestream to mainstream flavour delivery ratio of at least 9:1.

28. A smoking article according to claim 27, wherein said spearmint oil has a sidestream to mainstream flavour delivery ratio of at least 100:1.

29. A smoking article according to claim 1, wherein said smoking article is ventilated.

* * * * *